United States Patent [19]

Boulet

[11] Patent Number: 4,647,739

[45] Date of Patent: Mar. 3, 1987

[54] TWO-THRESHOLD PRESSURE SWITCH

[75] Inventor: Jacques Boulet, Cormeilles-en-Parisis, France

[73] Assignee: Jaeger, France

[21] Appl. No.: 817,478

[22] Filed: Jan. 9, 1986

[30] Foreign Application Priority Data

Jan. 11, 1985 [FR] France ..... 85 00376

[51] Int. Cl.[4] ..... H01H 35/34

[52] U.S. Cl. ..... 200/81.4; 200/83 J

[58] Field of Search ..... 200/83 R, 83 A, 83 J, 200/81.4, 81.5, 81 R; 340/626; 307/118; 73/861.47, 717, 723, 744, 745

[56] References Cited

U.S. PATENT DOCUMENTS 4,343,974 8/1982 Hire ..... 200/83 J 4,591,677 5/1986 Hirota ..... 200/81.4

FOREIGN PATENT DOCUMENTS 2513313 3/1983 France ..... 200/83 J

*Primary Examiner*—G. P. Tolin

*Attorney, Agent, or Firm*—McCormick, Paulding & Huber

[57] ABSTRACT

A two-threshold pressure switch, for example for providing an early warning and an alarm condition concerning oil pressure in a hydraulic circuit for lubricating or braking a vehicle, comprises an insulating housing (1) bearing contact blades (spade-type blades 5 and 6), and receiving a moving member (14) driven by a pressure-sensitive membrane (12) and supporting contact members (16, 17) for making selective contact with a fixed conductive cup (10). In accordance with the invention, said fixed cap closes a cavity (9) in said insulating housing (1) in such a manner that said moving member (14), said contact members (16, 17), and resilient contact member holding means (22, 23) are all located on the same side of the cap (10). Said moving member (14) is in the form of a sleeve having a first one of said contact members (16) slidably mounted on its outside and having a second one of said contact members (17) slidably mounted on its inside. Different outside and inside abutments (27, 15) are associated with respective ones of said contact members to provide two different pressure thresholds for said switch.

9 Claims, 1 Drawing Figure

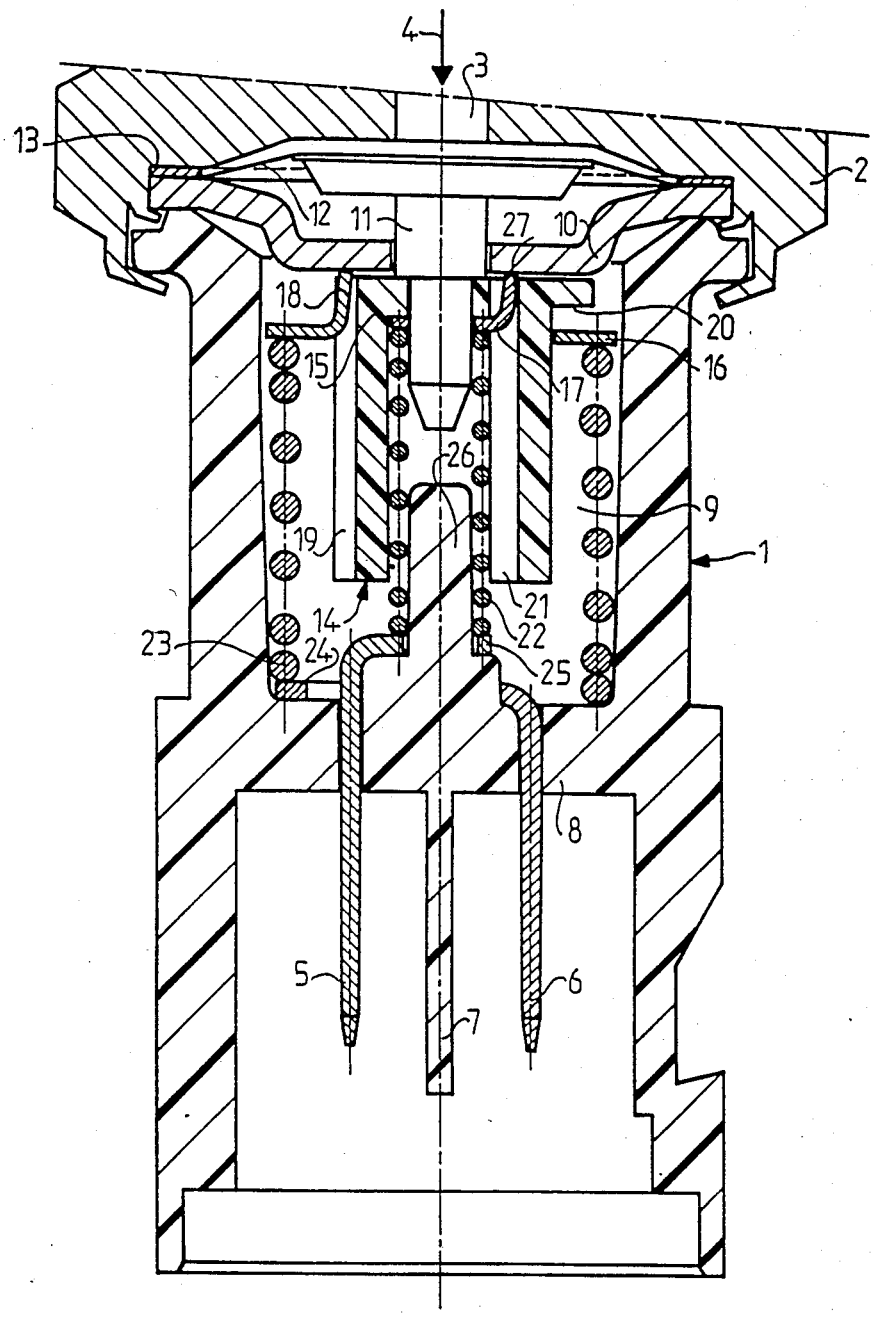
4
3
13
2
12
11
27
10
18
20
15
16
17
26
9
19
1
14
21
23
24
22
25
8
5
6
7

TWO-THRESHOLD PRESSURE SWITCH

The present invention relates to a pressure switch, such as a switch for monitoring a variable working pressure to indicate when the pressure varies beyond a predetermined threshold, and more particularly, the present invention relates to a two-threshold pressure switch.

BACKGROUND OF THE INVENTION

Such devices are used to detect excessive loss of pressure, for example the oil pressure in a motor vehicle oil pump, or to detect excessive increase in pressure, for example in enclosures containing gas under high pressure A warning indication is then given to make it possible to take action to avoid the dangers which are the normal consequences of such variations in pressure beyond predetermined thresholds.

The state of the art may be illustrated by U.S. Pat. No. 3,064,094, by British Pat. No. 1 304 085 or by French Pat. No. 2 521 341. Reference can also be made to earlier devices shown in British Pat. No. 1 440 756, U.S. Pat. No. 3,121,145, and French Pat. No. 2 107 788.

Most existing devices include only one moving contact member, even though some applications require two detection thresholds: a first to give a warning; and a second to indicate that the situation has become dangerous and in general that operation must be stopped.

Present two-threshold devices are complicated in structure, require a large number of component parts, and are not always very reliable, mechanically or electrically.

A typical two-threshold device is described in French Pat. No. 2,513,313 which shows a pressure switch including an insulating housing bearing contact blades, and having a cavity which receives an insulating moving member supporting contact members. The device further includes a fixed conductive cap having a pusher passing therethrough, with one end of the pusher being in mechanical contact with a membrane whose opposite face is subjected to the action of a pressure. Resiliently deformable holding means urge the contact members against the fixed conductive cap, and said contact members co-operate with said cap to open or close an electric circuit including said tact blades as a function of the pressure acting on the membrane relative to two predetermined threshold pressures.

The structure of this prior device is complicated, and in particular the fixed conductive cap is in the form of a kettle drum having several openings therethrough, and the associated contact member has three branches. The component parts are located on both sides of the drum wall, thereby complicating the structure and the operation of the device, and also providing extreme positions in which one contact is closed while the other is open, which means that an external relay must be provided in order to obtain extreme positions in which both contacts are in the same configuration. Further, such complex structure reduces both the reliability and the accuracy of the device: in addition to the danger of the telescopic parts jamming, there is a risk of the contact disposed between the end of the insulating moving member and the wall of the fixed conductive drum being crushed in the event of a pulse of excess pressure (hammering); finally, since the active area of the membrane varies in the course of operation (pusher, then pusher plus moving member), a suitably stiff supporting spring must be provided, in spite of the reduced accuracy entailed thereby.

In the motor manufacturing industry, in particular, there is a need for monitoring and/or warning devices for use with hydraulic circuits for lubrication or for braking, and such devices should be reliable, accurate, and competitive in price.

An object of the invention is to provide a two-threshold pressure switch for monitoring and/or providing warning signals concerning abnormal pressure variations, which switch should be simple in structure and capable of long-term accuracy and reliability.

Another object of the invention is to provide a switch capable of being used both for abnormal pressure increases and for abnormal pressure drops.

Another object of the invention is to provide a pressure switch capable of directly replacing an existing switch without requiring complicated disassembly.

SUMMARY OF THE INVENTION

The present invention provides a two-threshold pressure switch comprising an insulating housing bearing first and second contact blades, and having a cavity which receives:

an insulating moving member supporting first and second contact members;

a fixed conductive cap having a pusher passing therethrough, with said pusher being in mechanical contact with a membrane whose opposite face is subjected to the action of a pressure; and resiliently deformable holding means urging said contact members towards said fixed conductive cap, with said contact members co-operating with said cap to open or close corresponding electrical circuits including said contact blades as a function of the pressure acting on said membrane relative to two predetermined thresholds;

said pressure switch including the improvements whereby said fixed conductive cap closes an open end of said cavity in said insulating housing such that said moving member, said contact members, and said resiliently deformable holding means are all located on the same side of said cap; and whereby said moving insulating member is a sleeve having said first contact member slidably mounted on the outside thereof and said second contact member slidably mounted on the inside thereof, said sleeve having an outside abutment and an inside abutment respectively associated with said first and second slidably mounted contact members, with said resiliently deformable holding means and said abutments being designed to provide said pressure switch with first and second pressure thresholds, such that said switch is capable of occupying a first position in which both contact members close corresponding electrical circuits, a second position in which only one of said contact members closes its associated electrical circuit, and a third position in which both of said circuits are open.

Depending on the specific utilization, the first position corresponds to normal pressure, with the second and third positions corresponding to two predetermined thresholds of excess pressure, or alternatively the third position corresponds to normal pressure with the second and third positions corresponding to two predetermined thresholds of insufficient pressure.

Said holding means are advantageously coaxial springs lodged in the cavity in the insulating housing, each of said springs providing electrical connection between a corresponding one of said contact members and its associated contact blade.

The sleeve constituting the moving insulating member is advantageously provided with inside and outside longitudinally-extending grooves, with each groove receiving a tab from an associated one of the contact members, which tabs are curved towards the fixed conductive cap to come into abutting contact thereagainst.

In order to obtain a structure which is simple and compact, it is advantageous to mount the sleeve directly on the end of the pusher; said end of the pusher then extends inside the moving member to come into abutment with a central projection from the insulating housing, which projection extends from a wall of said housing through which said contact blades also pass. The pusher extends into the moving member through an end wall whose inside face constitutes the abutment for the inside contact member, with said contact member having a curved tab passing through an opening in said end wall. The end of the pusher then serves as a guide for the spring which urges the contact member inside the moving member towards said end wall of the moving member.

BRIEF DESCRIPTION OF THE DRAWING

A preferred embodiment of the invention is described by way of example with reference to the accompanying drawing, in which the sole FIGURE is an axial section through a pressure switch in accordance with the invention.

DESCRIPTION OF PREFERRED EMBODIMENT

The pressure switch shown comprises an insulating housing 1 for fixing, preferably by crimping, to a generally hexagonal metal body 2 having a threaded shaft which includes a central bore 3 for transmitting a working pressure as indicated by an arrow 4.

In known manner, one end of the housing 1 includes two recesses for receiving electrical connection terminals for electrical connection on respective flat contact blades 5 and 6. A partition 7 separates said recesses. The blades 5 and 6 pass through a wall 8 of the housing 1. Outside said wall 8, each blade 5 or 6 has a conventional spade-shaped portion for mating with a corresponding electrical contact terminal, and inside said wall 8, each blade 5 or 6 has a portion which is shaped in a manner described in greater detail below, and which is received inside a cavity 9. The cavity 9 opens out at the other end of said housing 1 and serves to receive the moving members of the pressure switch.

A conductive cap 10 closes the open end of the cavity 9 and has a pusher 11 of insulating material passing through the middle thereof. The pusher 11 is in contact with a membrane 12 whose periphery is clamped between a rim of the cap 10 and a sealing ring 13, with the assembly being received in a corresponding bore in the metal body 2 and being crimped thereto in such a manner as to ensure proper sealing. The opposite face of the membrane 12 is thus subjected to the working pressure. Said conductive cap 10 is in electrical contact with the metal body 2 and is conventionally dish-shaped in order to support the membrane 12 without pinching, regardless of the position of the pusher 11 relative to the bottom of said cap.

The pressure switch also includes an insulating moving member 14 received in the cavity 9 of the housing 1 and having a base 15 which is directly mounted to the end of the pusher 11. The moving member 14 may be held in place by adhesive, or else by the combined effects of a stop and a spring, as shown. The moving member 14 is sleeve-shaped and it supports two slidably-mounted contact members 16 and 17. The contact member 16 is mounted on the outside of the sleeve 14 and is in the form of a washer having a tab 18 which initially projects radially inwardly, and which is subsequently bent towards the conductive cap 10 in order to constitute a contact abutment therewith. The tab 18 is received in a longitudinally-extending outside groove 19 in the sleeve 14 which groove guides the contact member 16 without jamming. Similarly, the contact member 17 which is mounted inside the sleeve 14 is in the form of a washer having a tab 27 which initially projects radially outwardly, and which is subsequently bent towards the conductive cap 10 in order to constitute a contact abutment therewith. The tab 27 is similarly received in a longitudinally-extending inside groove 21 in the sleeve 14, and it passes through the end wall 15 of the sleeve 14 via a corresponding opening which constitutes a direct extension of said groove 21.

Holding means are provided which urge the contact members 16 and 17 towards the fixed conductive cap 10, and abutment means associated with said members are also provided.

In the present example, said holding means are constituted by coaxial springs, including an inside spring 22 for the inside contact member 17 and an outside spring 23 for the outside contact member 16. Said springs also act as electrical conductors for putting each of the contact members into connection with an associated one of the contact blades. Thus, the spring 23 presses the contact member 16, i.e. its tab 18, against the conductive cap 10, while its other end presses against a folded-back ring 24 extending from the contact blade 6. The spring is kept in place by the inside wall of the cavity 9 being slightly flared towards its opening. In order to avoid rocking in the bearing plane of the spring 23, a wedge (not shown) could be provided to take up the clearance between the ring 24 and the wall, or else the ring may be wide and may occupy nearly one complete turn to provide support for the entire end turn of the spring. Similarly, the spring 22 presses the contact member 17, i.e. its tab 20, against the conductive cap 10, while its other end presses against a folded-back ring 25 extending from the contact blade 5. This spring is kept in place by the end of the pusher 11 and by a central projection 26 projecting inwardly from the wall 8 of the housing. It should be observed that the projection 26 constitutes an end stop for the pusher 11 which is better than mere abutment between the pusher washer and the cap 10.

Stop means are advantageously provided on the sleeve 14 itself. In the example described, its base 15 constitutes the inside abutment associated with the contact member 17, and a flange 27 (which may be complete or partial) constitutes the outside abutment associated with the contact member 16. Naturally, in order to provide two different predetermined thresholds, the abutments must correspond to different amounts of axial travel.

It is important to observe that in the context of the present invention, the fixed conductive cap closes the end of the cavity in the insulating housing so that the insulating moving member 14, the contact members 16 and 17, and the springs 22 and 23 are all disposed on the same side of the cap, which can therefore be manufactured very simply, e.g. by stamping. This enables a particularly simple overall structure to be obtained, with long-term reliability (the risk of jamming is practically zero, and there is no risk of a contact being crushed by pressure hammering) and with high accuracy (the working area of the membrane remains constant and equal to the area adjacent the end of the pusher, thereby making reduced spring stiffness possible).

The above-described pressure switch in accordance with the invention operates as follows.

The position shown in the FIGURE is a rest position, as occupied by the pressure switch in the absence of any pressure. When the nominal working pressure is applied thereto (arrow 4), the insulating pusher 11 moves close to the bottom of the conductive cap 10 (or into contact therewith) so that the abutments 15 and 27 hold the tabs 20 and 18 of the associated contact members away from the cap 10. The associated electrical circuits are open. If the applied pressure falls off, the combined effect of the springs 22 and 23 causes the sleeve 14 to move towards the cap 10 until the first threshold is reached with the tab 18 abutting (on its own) against the conductive cap 10, while the other tab 20 is still held away therefrom. As a result, the circuit associated with the contact blade 6 is closed (via the ring 24 and the spring 23) while the circuit associated with the other blade 5 remains open. This first contact may be used to light a first warning lamp (e.g. an orange lamp). If the pressure falls off further, the tab 20 will in turn come into contact with the cap 10, at the second predetermined threshold and both circuits (blades 5 and 6) will be olosed. Closing the blade 5 circuit may be used to light a second warning lamp (e.g. a red lamp). It may be observed that in each extreme position, both contacts are either open or closed, with the intermediate condition of one open contact and one closed contact corresponding to an intermediate position. This is a more coherent state of affairs than in the prior art, and in particular, an external inverter (e.g. a relay) is not required.

The stiffnesses and lengths of the springs, together with the axial travel available between abutments determine the sensitivity of the pressure switch and its range of operating pressures, with the specific threshold pressures being predetermined for each application. Adjustable thresholds may be provided by acting on the accessible portions of the blades 5 and 6, i.e. by displacing their associated rings 25 and 24.

A pressure switch in accordance with the invention is naturally capable of operating in either direction. For example, if the predetermined thresholds concern excessive pressures, the illustrated position becomes the nominal pressure position. As pressure increases the sleeve 14 moves away from the cap 10 against the resilience of the springs 22 and 23 until the tab 20 is moved away from the cap 10 by the associated inside abutment 15, thereby determining the first threshold. With a further increase in pressure, the abutment 27 acts on the contact member 16 and moves the associated contact tab 18 out of contact with the cap 10, thereby determining the second threshold.

The invention is not limited to the specific embodiment described above with reference to the drawing, but covers any variant which falls within the scope of the claims. In particular, the electrical and the mechanical functions of the springs may be separated by providing additional electrical contact means. Return means could also be provided which act directly on the pusher. Finally, the blades and/or the contact members may be given different shapes depending on the types of applications and oonnections required.

I claim:

1. A two-threshold pressure switch comprising an insulating housing bearing first and second contact blades, and having a cavity which receives:

an insulating moving member supporting first and second contact members;

a fixed conductive cap having a pusher passing therethrough, with said pusher being in mechanical contact with a membrane whose opposite face is subjected to the action of a pressure; and resiliently deformable holding means urging said contact members towards said fixed conductive cap, with said contact members co-operating with said oap to open or close corresponding electrical circuits including said contact blades as a function of the pressure acting on said membrane relative to two predetermined thresholds;

said pressure switch including the improvements whereby said fixed conductive cap closes an open end of said cavity in said insulating housing such that said moving member, said contact members, and said resiliently deformable holding means are all located on the same side of said cap; and whereby said moving insulating member is a sleeve having said first contact member slidably mounted on the outside thereof and said second contact member slidably mounted on the inside thereof, said sleeve having an outside abutment and an inside abutment respectively associated with said first and second slidably mounted contact members, with said resiliently deformable holding means and said abutments being designed to provide said pressure switch with first and second pressure thresholds, such that said switch is capable of occupying a first position in which both contact members close corresponding electrical circuits, a second position in which only one of said contact members closes its associated electrical circuit, and a third position in which both of said circuits are open.

2. A pressure switch according to claim 1, wherein said first position corresponds to normal pressure, and said second and third positions correspond to two predetermined thresholds of increasing pressure.

3. A pressure switch according to claim 1, wherein said third position corresponds to normal pressure, and said second and first positions correspond to two predetermined thresholds of reducing pressure.

4. A pressure switch according to claim 1, wherein said contact member holding means are constituted by coaxial springs lodged inside said cavity in said insulating housing, said springs providing respective electrical connections between associated ones of said contact members and said contact blades.

5. A pressure switch according to claim 1, wherein said moving member has a first, outside, longitudinally-extending groove and a second, inside, longitudinally-extending groove, with each of said grooves receiving a tab from a corresponding one of said contact members, said tabs being curved towards said fixed conductive cap in order to come into abutting engagement therewith.

6. A pressure switch according to claim 1, wherein said insulating moving member is directly mounted on one end of said pusher.

7. A pressure switch according to claim 6, wherein said end of the pusher extends inside said moving member to come into abutment with a central projection inside said insulating housing, said projection extending from a wall of said housing through which said contact blades pass.

8. A pressure switch according to claim 6, wherein said end of said pusher passes through an end wall of said moving member with the inside face of said end wall constituting said inside abutment, and with said inside contact member having a tab which passes through said end wall.

9. A pressure switch according to claim 8, wherein said end of said pusher serves to guide a spring for holding said inside contact member against said end wall of said moving member.

* * * * *